US006145268A

United States Patent [19]

Korzen

[11] Patent Number: 6,145,268

[45] Date of Patent: Nov. 14, 2000

[54] APPARATUS AND METHOD FOR PROVIDING A REINFORCED ROOF TRUSS

[76] Inventor: Thomas G. Korzen, 4955 N. Cumberland Ave., Norridge, Ill. 60656

[21] Appl. No.: 09/216,600

[22] Filed: Dec. 18, 1998

[51] Int. Cl.[7] ..... E04B 1/18

[52] U.S. Cl. ..... 52/712; 52/633; 52/639; 52/714; 52/223.8; 52/223.9; 52/223.1

[58] Field of Search ..... 52/712, 714, 639, 52/223.8, 223.9, 223.1

[56] References Cited

U.S. PATENT DOCUMENTS

| | | | |
|---|---|---|---|
| 187,513 | 2/1877 | Colby | 52/639 |
| 4,897,979 | 2/1990 | Colonias | 52/639 |
| 4,932,173 | 6/1990 | Commins | 52/712 |

*Primary Examiner*—Carl D. Friedman
*Assistant Examiner*—Christy M. Syres
*Attorney, Agent, or Firm*—Welsh & Katz, Ltd.

[57] ABSTRACT

A reinforced truss includes a pre-existing top chord and a pre-existing bottom chord, a reinforcing top chord, first and second reinforcing chord heel plates, each of the reinforcing chord heel plates having a plate, a reinforcing truss bracket attached to a first end of the plate, at least one slotted aperture disposed on the plate and spaced to approximately match a pre-existing bolt pattern of the pre-existing truss, and a tie rod bracket. The ends of the reinforcing top chord are captured in the reinforcing truss brackets of the reinforcing chord heel plates. A tie rod is connected to the tie rod brackets of the first and second reinforcing chord heel plates. The slotted aperture allows for the tie rod to be adjusted, thereby adjusting the loading on the reinforcing top chord.

9 Claims, 2 Drawing Sheets

APPARATUS AND METHOD FOR PROVIDING A REINFORCED ROOF TRUSS

BACKGROUND

This invention relates to trusses. In particular, the invention relates to reinforcing roof trusses having an adjustable reinforcing chord heel plate.

Trusses to support a convex roof are well known. Many such trusses are made of wood, and can span more than 100 feet in length. Wooden trusses are subject to rot, splitting, cracking, insect infestations, or other forms of age-related degradation. Additionally, the load placed on a wooden truss may exceed the original expected loading for the truss for a variety of reasons, including the addition of hoists, machinery such as heating, ventilating, and air conditioning equipment, or additional layers of exterior roofing materials. Existing trusses may require reinforcement for any of these or other reasons.

Known trusses generally have one or more top chords, which are subject to compression loading, and one or more bottom chords, which are subject to tension loading. The top and bottom chords are typically connected at a heel connection setting plate. One known way of reinforcing such a truss is to install additional top chords from end to end of the truss. At the heel connection, the new top chords were simply clamped to the setting plate. A problem with the known way to reinforce a truss is that clamping the top chord down to the setting plate did not prevent the top chord from sliding out.

SUMMARY

The present invention provides for installing a reinforcing chord heel plate that engages the loading of the reinforcing top chords into the loading of the existing top chords, so both the old and new top chords work together.

The present invention for reinforcing a preexisting truss provides for a reinforcing chord heel plate having a reinforcing truss bracket, apertures spaced to match bolt patterns from a top chord of the pre-existing truss, and a tie rod bracket.

The present invention also provides for a reinforced truss having a pre-existing top chord, a reinforcing top chord, a bottom chord, first and second reinforcing chord heel plates, each reinforcing chord heel plate having a reinforcing truss bracket, apertures spaced to match bolt patterns from a top chord of the pre-existing truss, and a tie rod bracket, the reinforcing top chord having a first end captured in the reinforcing truss bracket of the first reinforcing chord heel plate and a second end captured in the reinforcing truss bracket of the second reinforcing chord heel plate, and a tie rod connecting the first and second reinforcing heel plates.

DETAILED DESCRIPTION

Figure 1:
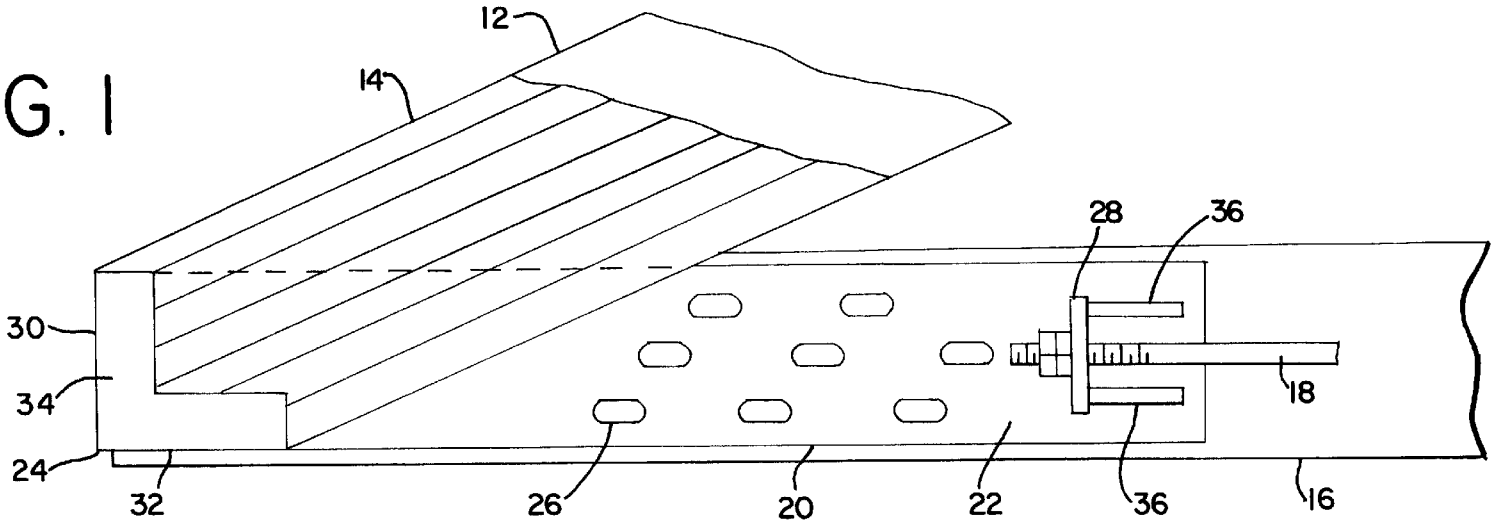
FIG. 1 shows one example of a truss heel of the present invention.

Known trusses generally have one or more top chords and one or more bottom chords. The top and bottom chords are typically connected at a heel connection setting plate. The bottom chords may be connected to the setting plates with lag bolts.

Referring now to FIGS. 1–4, a reinforced truss 10 of the present invention includes a pre-existing top chord 12, a reinforcing top chord 14, a bottom chord 16, a tie rod 18, and first and second reinforcing chord heel plates 20. In the illustrated embodiment, there are two reinforcing top chords 14, one installed on either side of two pre-existing top chords 12. Also, there are four reinforcing chord heel plates 20, one for each end of the two reinforcing top chords 14.

The reinforcing chord heel plate 20 of the present invention has a plate 22, reinforcing truss bracket 24 attached to a first end of the plate 22, at least one slotted aperture 26, and preferably, a plurality of slotted apertures 26 disposed on the plate 22 and spaced to approximately match bolt patterns from a top chord of the pre-existing truss, and a tie rod bracket 28. The reinforcing chord heel plate 20 may be fabricated from steel.

Figure 2:
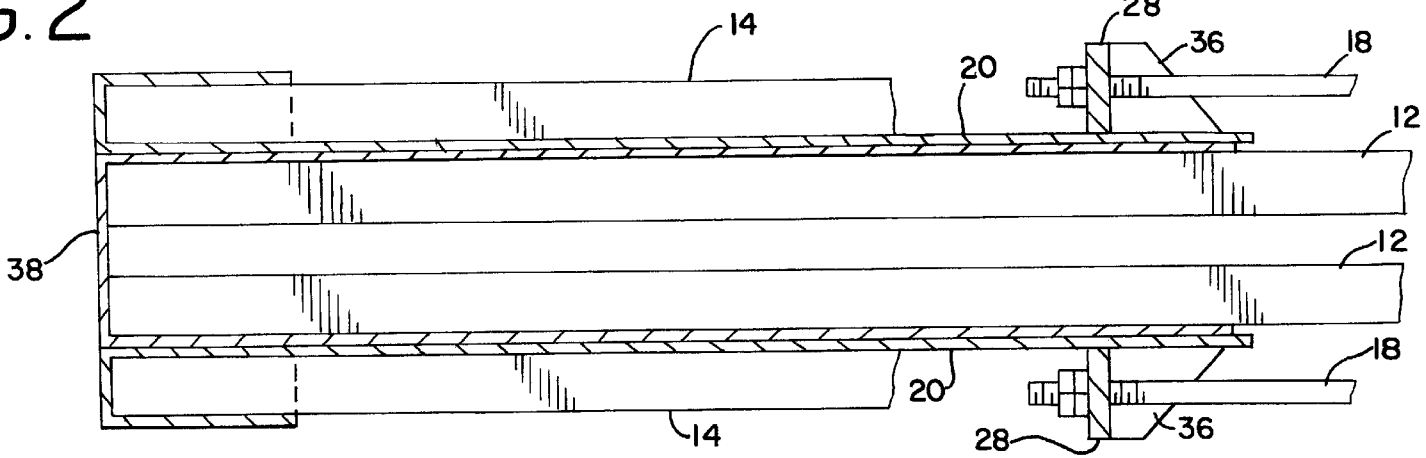
FIG. 2 shows a plain view of one example of a truss heel of the present invention.
Figure 3:
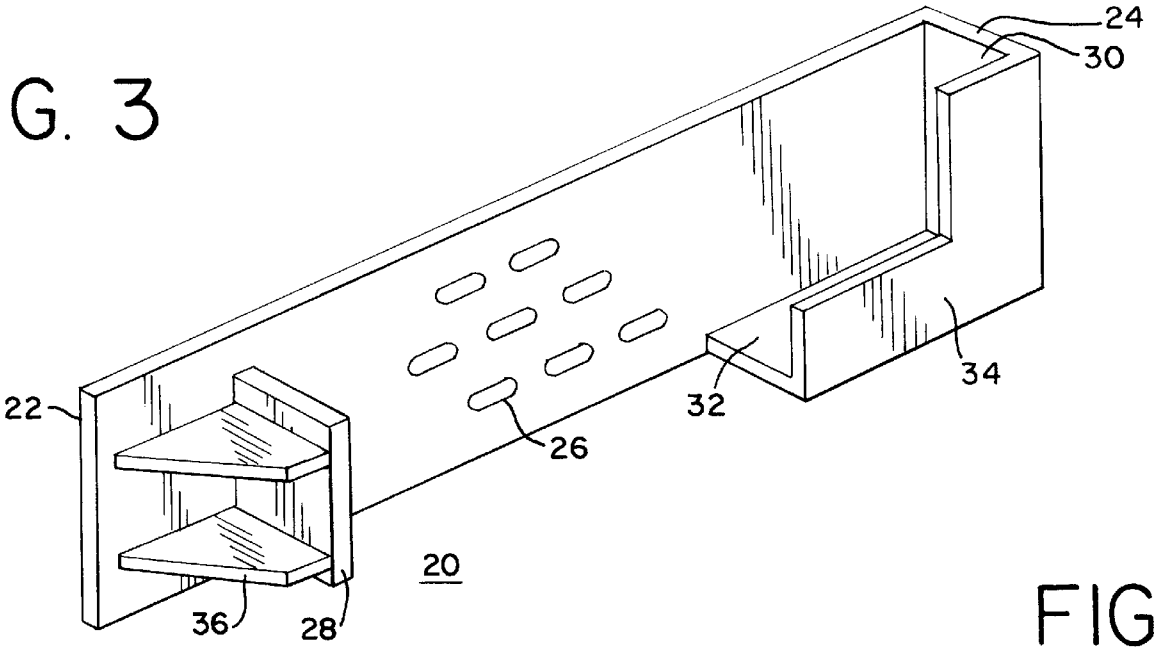
FIG. 3 Shows a perspective view of one example of a reinforcing chord heel plate of the present invention.
Figure 4:
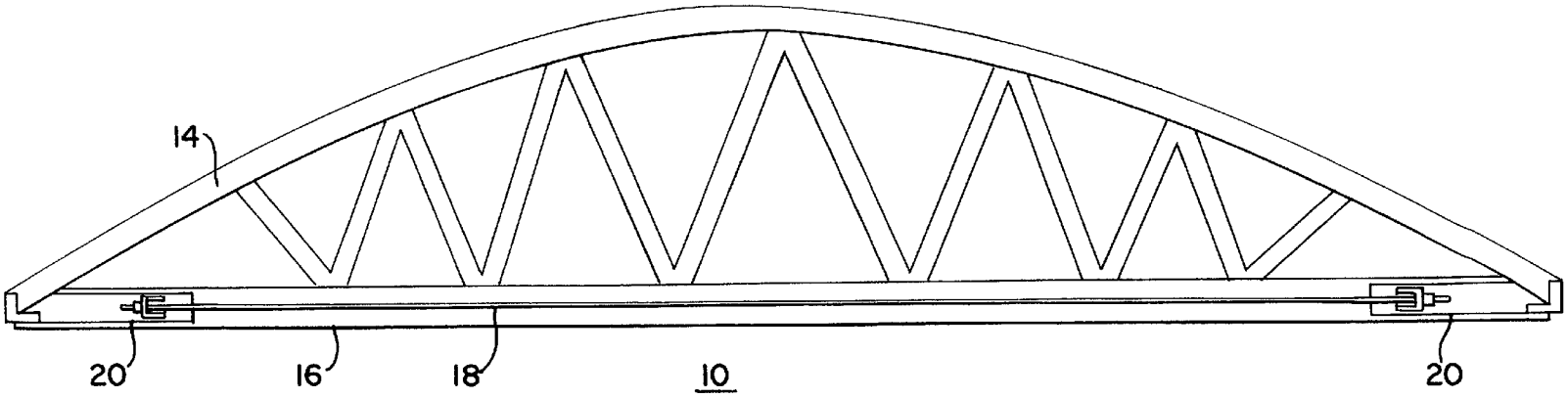
FIG. 4 shows one example of a reinforced truss of the present invention.

In the embodiment illustrated in FIGS. 2–4, the reinforcing truss bracket 22 comprises a pair of planar bracket surfaces 30 and 32 extending at ninety degree angles to each other and to the plate 22. These surfaces form an "L" shaped bracket. The reinforcing truss bracket 22 illustrated in the Figures may further comprise a third bracket surface 34, parallel to the plate 22 and attached to the bracket surfaces 30 and 32 for further security in capturing the reinforcing top chord 20. The reinforcing truss bracket 24 may be formed integrally with the plate 22, or separately fabricated and later attached. For example, the pair of bracket surfaces 30 and 32 may be welded onto plate 22, and third bracket surface 34 may be welded to bracket surfaces 30 and 32. Alternatively, an angle iron may be used to form bracket surface 30 and a portion of bracket surface 34, while another angle iron may be used to form bracket surface 32 and the remainder of bracket surface 34. Also, various shapes and configurations of the reinforcing truss bracket 24 may be substituted for the illustrated reinforcing truss bracket 24 without departing from the spirit of the invention.

The slotted apertures 26 are disposed on the plate 22 to approximately match the bolt pattern of the pre-existing truss. The slotted apertures 26 are longer horizontally than vertically.

The tie rod bracket 28 is located at a second end of the plate 22. The tie rod bracket 28 may be a simple planar surface extending from the plate 22. As illustrated, the tie rod bracket 28 includes reinforcing members 36. The tie rod bracket 28 may be formed integrally with the plate 22, or separately fabricated and later attached. For example, tie rod bracket 28 and reinforcing members 36 may be welded onto plate 22. Various shapes and configurations of the tie rod bracket 28 may be substituted for the illustrated tie rod bracket 28 without departing from the spirit of the invention.

In the reinforced truss 10, the reinforcing top chord 14 has a first end captured in the reinforcing truss bracket 24 of the first reinforcing chord heel plate 20 and a second end captured in the reinforcing truss bracket 24 of the second reinforcing chord heel plate 20. The tie rod 18 connects the first and second reinforcing heel plates 20 via the tie rod brackets 28 of each reinforcing heel plate 20.

In use, the reinforcing top chord 14 is cut to fit the span of the pre-existing top chord 12 and to fit the reinforcing top chord 14 brackets of the reinforcing chord heel plates 20. Each reinforcing chord heel plate 20 is installed by loosely bolting the reinforcing chord heel plate 20 through the bottom chord (or chords) 16 and the pre-existing setting plates 38. The tie rods 18 are installed on the tie rod brackets 28, but not tightened. The reinforcing top chord 14 is installed, with its ends captured in the reinforcing top chord 14 brackets. At this time, the tie rods are tightened until the reinforcing top chord 14 is sufficiently compressed to support the loading of the roof. The slotted apertures 26 of the plate 22 allow the reinforcing chord heel plates 20 to be drawn together and compress the top reinforcing chord 14. When the tie rods 18 have been tightened, the bolts are tightened, and the plate 22 is fixed in place.

Specific embodiments of the truss reinforcement method and apparatus have been described herein for purposes of illustrating the manner in which the invention may be made and used. It should be understood that implementation of other variations and modifications of the invention in its various aspects will be apparent to those skilled in the art, and that the invention is not limited thereto by the specific embodiments described. It is therefore contemplated to cover by the present invention any and all modifications, variations or equivalence that fall within the true spirit and scope of the basic underlying principles disclosed and claimed herein.

In describing and claiming the present invention, the use of the indefinite article "a" means "at least one," and should not be limited to "only one" unless explicitly indicated to the contrary. The descriptions of the trusses being made of wood is not intended to be a limitation of the present invention unless the building material is expressly recited in the claims.

What is claimed is:

1. A reinforced truss, including a pre-existing top chord and a pre-existing bottom chord, comprising:

a first reinforcing top chord, having first and second ends;

first and second reinforcing chord heel plates, each of the reinforcing chord heel plates having a plate, a reinforcing truss bracket attached to a first end of the plate, at least one slotted aperture disposed on the plate and spaced to approximately match a pre-existing bolt pattern of the pre-existing truss, and a tie rod bracket;

the first end of the first reinforcing top chord captured in the reinforcing truss bracket of the first reinforcing chord heel plate and the second end of the first reinforcing top chord captured in the reinforcing truss bracket of the second reinforcing chord heel plate; and a first tie rod connected to the tie rod brackets of the first and second reinforcing chord heel plates.

2. The reinforced truss of claim 1 further comprising:

second reinforcing top chord, having first and second ends;

third and fourth reinforcing chord heel plates;

the first end of the second reinforcing top chord captured in the reinforcing truss bracket of the third reinforcing chord heel plate and the second end of the second reinforcing top chord captured in the reinforcing truss bracket of the fourth reinforcing chord heel plate; and a second tie rod connected to the tie rod brackets of the third and fourth reinforcing chord heel plates.

3. The reinforced truss of claim 1, wherein the reinforcing truss bracket comprises a pair of planar bracket surfaces extending from the plate.

4. The reinforced truss of claim 3, where in the reinforcing truss bracket further comprises a third bracket surface parallel to the plate and attache d to the pair of planar bracket surfaces.

5. The reinforced truss of claim 1, wherein the slotted aperture comprises a plurality of slotted apertures, and wherein the slotted apertures are longer horizontally than vertically.

6. A reinforced truss, including a pre-existing top chord and a pre-existing bottom chord, comprising:

a reinforcing top chord, having first and second ends; and means for compressing the reinforcing top chord.

7. The reinforced truss of claim 6, wherein the means for compressing the reinforced top chord further comprises:

first and second means for adjustably loading the reinforcing top chord connected to the first and second ends of the reinforcing top chord, respectively; and a tie rod connected to the first and second means for adjustably loading the reinforcing top chord.

8. The reinforced truss of claim 7, wherein each of the first and second means for adjustably loading the reinforcing top chord further comprises:

a plate;

means for capturing the reinforcing top chord;

at least one slotted aperture disposed on the plate and spaced to approximately match a pre-existing bolt pattern of the pre-existing truss; and means for connecting to a tie rod.

9. A method for reinforcing a truss, including a pre-existing top chord and a pre-existing bottom chord, comprising the steps of:

loosely bolting a first reinforcing chord heel plate through at least one slotted aperture on the first reinforcing chord heel plate and through a first end of the pre-existing bottom chord;

loosely bolting a second reinforcing chord heel plate through at least one slotted aperture on the second reinforcing chord heel plate and through a second end of the pre-existing bottom chord;

installing a tie rod between the first reinforcing chord heel plate and the second reinforcing chord heel plate;

installing a reinforcing top chord with first and second ends captured in brackets in the first and second reinforcing chord heel plates;

tightening the tie rod; and tightening the bolts through the slotted apertures on first and second reinforcing chord heel plates.

* * * * *